US007470653B2

(12) United States Patent
Gambogi et al.

(10) Patent No.: US 7,470,653 B2
(45) Date of Patent: Dec. 30, 2008

(54) LIQUID CLEANING COMPOSITION COMPRISING AN ANIONIC/BETAINE SURFACTANT MIXTURE HAVING LOW VISCOSITY

(75) Inventors: Joan Ethel Gambogi, Hillsborough, NJ (US); Cynthia McCullar Murphy, Belle Meade, NJ (US); David Frank Suriano, Edison, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 11/400,089

(22) Filed: Apr. 7, 2006

(65) Prior Publication Data

US 2007/0238631 A1 Oct. 11, 2007

(51) Int. Cl.
*C11D 1/12* (2006.01)
*C11D 1/90* (2006.01)

(52) U.S. Cl. ..... 510/237; 510/123; 510/125; 510/127; 510/235; 510/253; 510/269; 510/422; 510/423; 510/424; 510/425; 510/426; 510/427; 510/428; 510/432; 510/434; 510/477; 510/490; 510/495; 510/533

(58) Field of Classification Search ..... 510/237, 510/123, 125, 127, 235, 253, 269, 422, 423, 510/424, 425, 426, 427, 428, 432, 434, 477, 510/490, 495, 533
See application file for complete search history.

(56) References Cited

U.S. PATENT DOCUMENTS 3,658,985 A 4/1972 Olson, Jr.
3,676,340 A 7/1972 Berg et al.
3,769,398 A 10/1973 Hewitt
3,935,129 A 1/1976 Jabalee
3,982,892 A 9/1976 Gray
4,013,787 A 3/1977 Varlerberghe et al.
4,129,515 A 12/1978 Foster
4,154,706 A 5/1979 Kenkare et al.
4,224,195 A 9/1980 Kawasaki et al.
4,259,204 A 3/1981 Homma
4,329,334 A 5/1982 Su et al.
4,329,335 A 5/1982 Su et al.
4,329,336 A 5/1982 Su et al.
4,450,091 A 5/1984 Schmolka
4,595,526 A 6/1986 Lai
4,772,425 A 9/1988 Chirash et al.
5,057,246 A 10/1991 Bertho et al.
5,192,460 A 3/1993 Thomas et al.
5,294,364 A 3/1994 Thomas et al.
5,531,938 A 7/1996 Erilli
5,554,320 A 9/1996 Yianakopoulos
5,616,781 A * 4/1997 Sajic et al. ..... 510/221
5,714,454 A 2/1998 Thomas
5,741,769 A 4/1998 Erilli
5,756,441 A 5/1998 Thomas et al.
5,990,065 A 11/1999 Vinson et al.
6,013,611 A 1/2000 Thomas et al.
6,046,150 A 4/2000 Choy et al.
6,048,834 A 4/2000 Drapier et al.
6,051,542 A * 4/2000 Pollack et al. ..... 510/426
6,121,228 A 9/2000 Drapier et al.
6,136,769 A 10/2000 Asano et al.
6,147,039 A 11/2000 Jacques et al.
6,251,844 B1 6/2001 Leonard et al.
6,255,269 B1 7/2001 Leonard et al.
6,262,003 B1 7/2001 Leonard et al.
6,268,330 B1 7/2001 Leonard et al.
6,281,181 B1 8/2001 Vinson et al.
6,306,817 B1 10/2001 Kott et al.
6,339,055 B1 1/2002 Brooker et al.
6,441,037 B1 8/2002 Arvanitidou et al.
6,444,636 B1 9/2002 Toussaint et al.
6,475,967 B1 11/2002 Arvanitidou et al.
6,495,507 B1 12/2002 Arvanitidou
6,541,436 B1 4/2003 Arvanitidou et al.
6,583,178 B2 6/2003 D'Ambrogio et al.
6,586,014 B2 7/2003 Arvanitidou et al.
6,593,284 B2 7/2003 Arvanitidou et al.
6,605,579 B1 8/2003 Arvanitidou et al.
6,617,296 B1 9/2003 Connors et al.
6,627,589 B1 9/2003 Arvanitidou
6,696,399 B1 2/2004 Chernin et al.
6,759,382 B2 * 7/2004 Ahmed ..... 510/424
6,815,406 B1 11/2004 Szewczyk
6,821,939 B1 11/2004 Szewczyk et al.
6,884,764 B2 4/2005 Szewczyk et al.
2003/0144218 A1 7/2003 Arvanitidou et al.
2004/0101504 A1 5/2004 Kinscherf et al.
2004/0204331 A1 * 10/2004 Connors et al. ..... 510/424
2004/0229763 A1 11/2004 Hutton, III et al.
2004/0229766 A1 11/2004 Hutton, III et al.

(Continued)

OTHER PUBLICATIONS

File History From U.S. Appl. No. 11/868,839.

*Primary Examiner*—Charles I Boyer
(74) *Attorney, Agent, or Firm*—Michael U. Lee

(57) ABSTRACT

A light duty liquid cleaning composition comprising at least one ammonium or metal salt of a $C_8$-$C_{16}$ linear alkyl benzene sulfonate surfactant, at least one ammonium or metal salt of an ethoxylated $C_8$-$C_{18}$ alkyl ether sulfate surfactant having 1 to 30 moles of ethylene oxide, and at least one betaine surfactant; wherein (a) a total amount of surfactant in the composition is at least 30 weight %, (b) the composition has a pH less than 7 and a viscosity of less than 75 cPs measured at 25° C., (c) if a magnesium salt of a $C_8$-$C_{16}$ linear alkyl benzene sulfonate surfactant is present in the composition, it is present in an amount of 0.1 to less than 3 or greater than 16% by weight of the composition, and (d) the composition does not contain an inorganic magnesium salt.

14 Claims, No Drawings

U.S. PATENT DOCUMENTS

2004/0229767 A1 11/2004 Ford et al.
2004/0229963 A1 11/2004 Culeron et al.
2004/0254253 A1 12/2004 Culeron et al.
2005/0049161 A1 3/2005 Szewczyk
2005/0049170 A1 3/2005 Szewczyk
2005/0192196 A1 9/2005 Hutton, III et al.
2005/0256016 A1 11/2005 Oh et al.
2006/0115440 A1 * 6/2006 Arata et al. ..... 424/65

* cited by examiner

LIQUID CLEANING COMPOSITION COMPRISING AN ANIONIC/BETAINE SURFACTANT MIXTURE HAVING LOW VISCOSITY

BACKGROUND OF THE INVENTION

Foaming liquid cleaning compositions and dispensers for generating foaming cleaning compositions are known. Such compositions generally are in the form of a gel, liquid or paste and contain surfactants. Such cleansers typically foam when agitated in the presence of water, but to provide high foam levels prior to dilution with water, such as on application with a pump-foamer, the cleanser should have relatively low viscosity. As common surfactants tend to be relatively viscous, one way to reduce viscosity is simply to dilute the formulation so as to provide a high level of water or other solvent relative to surfactant. If it is desired to have good foaming properties while still maintaining high surfactant levels, however, other approaches may be required. For example, microemulsions are known in the art and include compositions containing oil, water, a surfactant and a co-surfactant so as to form a solution containing a dispersion of very small droplets. Microemulsion formulations are advantageous in that they generally have lower viscosities than non-microemulsion formulations having comparable total surfactant levels.

SUMMARY OF THE INVENTION

The present invention relates to a light duty liquid cleaning composition comprising at least one ammonium or metal salt of a $C_8$-$C_{16}$ linear alkyl benzene sulfonate surfactant, at least one ammonium or metal salt of an ethoxylated $C_8$-$C_{18}$ alkyl ether sulfate surfactant having 1 to 30 moles of ethylene oxide, and at least one betaine surfactant; wherein (a) a total amount of surfactant in the composition is at least 30 weight %, (b) the composition has a pH less than 7 and a viscosity of less than 75 cPs measured at 25° C., (c) if a magnesium salt of a $C_8$-$C_{16}$ linear alkyl benzene sulfonate surfactant is present in the composition, it is present in an amount of 0.1 to less than 3 or greater than 16% by weight of the composition, and (d) the composition does not contain an inorganic magnesium salt.

DETAILED DESCRIPTION OF THE INVENTION

As used throughout, ranges are used as a shorthand for describing each and every value that is within the range. Any value within the range can be selected as the terminus of the range.

Unless otherwise stated, references to weight % in this specification are on an active basis in the total composition.

The present invention relates to cleaning compositions that have high surfactant levels and low viscosity. Previous formulations of such compositions having low viscosity are generally microemulsion formulations such as oil-in-water or water-in-oil formulations wherein two immiscible liquids are present, and one of the two liquids is in a phase known as the dispersed phase which is immersed throughout a second phase, known as the continuous phase. The use of microemulsions for many different types of formulations is known such as personal care and cleaning products. Such formulations generally have a lower viscosity and do not contain a high level of surfactants as the surfactants may increase the viscosity of the non-microemulsion formulations, and reduce the desired cleaning and foaming properties of the compositions.

In one embodiment, the total amount of surfactant in the cleaning composition is at least 30% by weight of the composition. In another embodiment the total amount of surfactant is 30 to 45% by weight of the composition.

The present invention relates to a mixture of at least one ammonium or metal salt of a $C_8$-$C_{16}$ linear alkyl benzene sulfonate surfactant, at least one ammonium or metal salt of an ethoxylated $C_8$-$C_{18}$ alkyl ether sulfate surfactant having 1 to 30 moles of ethylene oxide, and at least one betaine surfactant, wherein the composition has a pH less than 7 and a viscosity of less than about 75 cPs measured at 25° C. The at least one ammonium or metal salt of a $C_8$-$C_{16}$ linear alkyl benzene sulfonate surfactant specifically excludes 3 to 16% by weight of the composition a magnesium salt of a $C_8$-$C_{16}$ linear alkyl benzene sulfonate surfactant. Also, inorganic magnesium salts are not present in the composition.

As used throughout, metal cations that can be used include, but are not limited to, alkali metal ions and alkaline earth ions. In some embodiments, the metal cation ion can be lithium, sodium, potassium, magnesium, or calcium. Of these, sodium can be used preferentially.

In one embodiment, the at least one ammonium or metal salt of a $C_8$-$C_{16}$ linear alkyl benzene sulfonate surfactant can be present in the cleaning composition in an amount that is at least 6 weight %. In another embodiment, the at least one ammonium or metal salt of a $C_8$-$C_{16}$ linear alkyl benzene sulfonate surfactant is present in an amount from greater than 6 to 30 weight %.

In one embodiment, the at least one ammonium or metal salt of a $C_8$-$C_{16}$ linear alkyl benzene sulfonate surfactant comprises a sodium salt of a $C_8$-$C_{16}$ linear alkyl benzene sulfonate surfactant that is present in the composition in an amount greater than 6% by weight. In another embodiment, this surfactant is present in an amount greater than 7% by weight. In another embodiment, this surfactant is present in an amount greater than 16% by weight. In another embodiment, this surfactant is present in an amount from greater than 6 to 30 weight %.

The ammonium or metal salt of an ethoxylated $C_8$-$C_{18}$ alkyl ether sulfate surfactant having 1 to 30 moles of ethylene oxide can have the structure:

$$R^{10}\text{—}(OCHCH_2)_n\text{—}OSO_3\text{-}M+$$

wherein n is 1 to 30 more preferably 1 to 3 and $R^{10}$ is an alkyl group having 8 to 18 carbon atoms, more preferably 12 to 15, and M is an ammonium cation or metal cation. In one embodiment, at least one ammonium or metal salt of an ethoxylated $C_8$-$C_{18}$ alkyl ether sulfate surfactant having 1 to 30 moles of ethylene oxide is present in the composition in an amount of 4 to 30 weight %.

The ethoxylated alkyl ether sulfate may be made by sulfating the condensation product of ethylene oxide and $C_8$-$C_{10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, such as sodium myristyl (3EO) sulfate.

The at least one betaine surfactant can be any betaine surfactant. In one embodiment, the betaine surfactant can have the general formula:

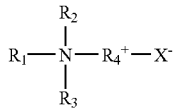

wherein $X^-$ is selected from the group consisting of $SO_3^-$ and $CO_2^-$ and $R_1$ is an alkyl group having 10 to 20 carbon atoms, preferably 12 to 16 carbon atoms, or the amido radical:

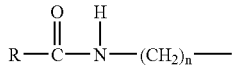

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having 1 to 4 carbon atoms and, optionally, one hydroxyl group. Typical alkydimethyl betaines include decyl dimethyl betaine or 2-(N-decyl-N, N-dimethyl-ammonia) acetate, coco dimethyl betaine or 2-(N-coco N, N-dimethyl ammonia) acetate, myristyl dimethyl betaine, palmityl dimethyl betaine, lauryl dimethyl betaine, cetyl dimethyl betaine, stearyl dimethyl betaine, etc. A preferred betaine derivative is coco ($C_8$-$C_{18}$) amidopropyl dimethyl betaine. In one embodiment, the betaine is present in the composition in an amount of 2 to 10 weight %.

In one embodiment of the present invention, the low viscosity cleaning composition comprises a mixture of surfactants and water-soluble organic solvents such that the viscosity of the solution is less than about 75 cPs as measured with a Brookfield Viscometer using a number 21 spindle rotating at 100 rpm at 25° C. In another embodiment, the viscosity is 35-65 cPs. In another embodiment, the viscosity is about 50 cPs.

The cleaning composition is an acidic composition such that the pH of the solution is less than 7. In one embodiment, the pH ranges in a value of 1-7. In another embodiment, the pH is less than 6. In another embodiment, the pH is less than 5. In another embodiment, the pH ranges in a value of 2 to 4. In another embodiment, the pH is 3.5.

The pH can be adjusted by any material that reduces the pH to less than 7. In one embodiment, an organic acid is used to adjust the pH to less than 7. Examples of organic acids include, but are not limited to, alpha-hydroxy acids, lactic acid, citric acid, salicylic acid, glycolic acid, ortho hydroxy benzoic acid, and combinations thereof. In another embodiment, an inorganic acid is used to adjust the pH. As a non-limiting example, the inorganic acid is sulphuric acid. Also, combinations of organic and inorganic acids can be used. The amount of material that reduces the pH can be any amount such that the a desired pH is achieved in the cleaning composition. In one embodiment when an organic acid is used, the organic acid can be present in an amount up to 2.5% by weight of the cleaning composition to act as a pH adjustor for the formulation.

The light duty liquid cleaning composition of the present invention comprises at least one water-miscible organic solvent. Such organic solvents include, but are not limited to, $C_{2-4}$ mono, dihydroxy, or polyhydroxy alkanols and/or an ether or diether, such as ethanol, isopropanol, dipropylene glycol methyl ether, diproyleneglycol monobutyl ether, propylene glycol n-butyl ether, propylene glycol, and hexylene glycol, and alkali metal cumene, alkali metal toluene, or alkali metal xylene sulfonates such as sodium cumene sulfonate and sodium xylene sulfonate. Preferred organic solvents of the present invention are ethanol and dipropylene glycol methyl ether, both of which are miscible with water. Urea can be optionally used at a concentration of 0.1% to 7 wt. %. In one embodiment, the organic solvent is freely soluble in water.

The light duty liquid cleaning composition can optionally include a corrosion inhibitor. When included, the corrosion inhibitor can reduce or prevent the corrosion of metal springs in a foaming pump dispenser. Foaming pump dispensers include a spring to allow the dispenser to return to its original position. Examples of corrosion inhibitors include, but are not limited to, sodium sulfate. In one embodiment, the amount of corrosion inhibitor is 0.02 to 2.0 weight %.

Additional ionic surfactants that can be used in the present invention are preferably anionic surfactants, as are well known in the art. Such surfactants are useful to enhance the stability of the formulation as well as to provide additional degreasing activity. Suitable water-soluble anionic surfactants include those surface-active or detergent compounds which contain an organic hydrophobic group containing generally 8 to 26 carbons and preferably 10 to 18 carbon atoms in their molecular structure and at least one water-solubilizing group which is a sulfonate group, so as to form a water-soluble detergent. Usually, the hydrophobic group will include or comprise a $C_8$-$C_{22}$ alkyl, aryl or acyl group. Examples of anionic surfactants include, but are not limited to, olefin sulfonates, including long-chain alkene sulfonates, long-chain hydroxyalkane sulfonates or mixtures of alkene sulfonates and hydroxyalkane sulfonates. Preferred anionic surfactants include alkyl sulfonates, alkyl aryl sulfonates, and aryl alkyl sulfonates, such as $C_{12-16}$ paraffin sulfonate or sodium xylene sulfonate. Examples of sulfonated anionic surfactants include, but are not limited to, higher alkyl mononuclear aromatic sulfonates such as the higher alkyl benzene sulfonates containing 10 to 16 carbon atoms in the higher alkyl group in a straight or branched chain, $C_8$-$C_{15}$ alkyl toluene sulfonates and $C_8$-$C_{15}$ alkyl phenol sulfonates.

The composition of the present invention may further comprise a non-ionic surfactant or mixtures thereof Suitable non-ionic surfactants for use herein are fatty alcohol ethoxylates which are commercially available with a variety of fatty alcohol chain lengths and a variety of ethoxylation degrees. Indeed, the HLB values of such non-ionic surfactants depend essentially on the chain length of the fatty alcohol and the degree of ethoxylation. Particularly suitable non-ionic surfactants are the condensation products of a higher aliphatic alcohol containing 8 to 18 carbon atoms in a straight or branched chain configuration, condenses with 2 to 30 moles of ethylene oxide.

Any rheology modifiers may be used. For example, an alkali metal halide such as sodium chloride may be added to the present composition to act as a viscosity reducer.

Additional optional ingredients may be included to provide added effect or to make the product more attractive. Such ingredients include perfumes, fragrances, colors, dyes, thickening agents, abrasive agents, disinfectants, radical scavengers, bleach, chelating agents, antibacterial agents/preservatives, or mixtures thereof. In some embodiments: colors or dyes can be present in amounts up to 0.5% by weight; bactericides in amounts up to 1% by weight; HEDTA for color improvement under stressed sun conditions in amounts up to 1%.

In some embodiments, preservatives can be used in the instant compositions at a concentration of 0 wt. % to 3 wt. %, more preferably 0.01 wt. % to 2.5 wt. %. Examples of preservatives include, but are not limited to, benzalkonium chloride; benzethonium chloride,5-bromo-5-nitro-1,3dioxane; 2-bromo-2-nitropropane-1,3-diol; alkyl trimethyl ammonium bromide; N-(hydroxymethyl)-N-(1,3-dihydroxy methyl-2,5-dioxo-4-imidaxolidinyl-N'-(hydroxymethyl) urea; 1-3-dimethyol-5,5-dimethyl hydantoin; formaldehyde; iodopropynl butyl carbamate, butyl paraben; ethyl paraben; methyl paraben; propyl paraben, mixture of methyl isothiazolinone/methyl-chloroisothiazoline in a 1:3 wt. ratio; mixture of phenoxythanol/butyl paraben/methyl paraben/propylparaben; 2-phenoxyethanol; tris-hydroxyethyl-hexahydrotriazine; methylisothiazolinone; 5-chloro-2-methyl-4-isothiazolin-3-one; 1,2-dibromo-2, 4-dicyanobutane; 1-(3-chloroalkyl)-3,5,7-triaza-azoniaadam-antane chloride; and sodium benzoate.

In some embodiments, the instant formulas explicitly exclude alkali metal silicates and alkali metal builders such as alkali metal polyphosphates, alkali metal carbonates, alkali metal phosphonates and alkali metal citrates because these materials can cause the composition to have a high pH as well as leaving residue on the surface being cleaned.

The cleaning compositions of the present invention have good foaming properties such that they can be applied using a roamer pump, sprayer, or similar device. They also can have grease cleaning, disinfectant, and rinsing properties, and are mild to the skin.

The invention also provides a method for cleaning grease and other such deposits comprising applying the composition of the invention to an area to be cleaned. If needed, the area can be scrubbed and followed by rinsing with water.

The formulations of the invention are preferably dispensed by a foaming pump to the area to be cleaned. Optionally, the pump on the spray bottle may have a foaming mechanism so that the formulation is dispensed in the form of a foam. Accordingly, the invention further provides a non-aerosol container containing a formulation of the invention and having a spray pump so that the formulation can be sprayed on the surface to be cleaned, e.g., wherein the spray pump is a foam-generating pump so that the formulation can be dispensed in the form of a foam.

The foam volume test is an inverted cylinder test in which 100 ml of 0.0335 wt. % of the cleaning composition in 150 ppm $Mg/CaCO_3$ hardened water is placed in a stoppered graduated cylinder (500 ml) and inverted 40 cycles at a rate of 30 cycles/minute. After 40 inversions, the foam height in the graduated cylinder is measured in ml's. After the volume is measured for this initial 40 cylinder inversions, the cylinder stopper is removed and 175 microliters of whole milk is added to the solution. The cylinder is then inverted for another 40 cycles and a foam volume with soil is measured. The values provided above include the 100 ml's of cleaning composition inside the cylinder.

In one embodiment, the cleaning composition can achieve an initial foam volume of at least 340 ml and a foam volume with soil of at least 120 ml.

The following prophetic examples illustrate cleaning compositions of the present invention. They can be prepared by mixing of the ingredients.

EXAMPLE 1

| | Wt. % on an active basis |
|---|---|
| Na Linear Alkylbenzene Sulfonate | 16-17 |
| Cocoamidopropyl Betaine | 4-5 |
| Lactic Acid | 2-3 |
| $NH_4$ Alcohol Ether Sulfate-1.3EO | 14-15 |
| Pentasodium pentetate | 0.1-0.2 |
| NaCl | 3-4 |
| Dipropylene glycol methyl ether | 6-7 |
| SD-3A alcohol | 6-7 |
| Perfume | 0.4-0.6 |
| Dye | 0.2-0.3 |
| Water | Balance |

EXAMPLE 2

| | Wt. % active basis |
|---|---|
| Na Linear Alkylbenzene Sulfonate | 16-17 |
| Cocoamidopropyl Betaine | 4-5 |
| Sodium Xylene Sulfonate | 3-4 |
| Lactic Acid | 2-3 |
| $NH_4$ Alcohol Ether Sulfate-1.3EO | 14-15 |
| Pentasodium pentetate | 0.1-0.2 |
| Sodium Sulfate | 0.2-0.3 |
| Dipropylene glycol methyl ether | 6-7 |
| SD-3A alcohol | 7-8 |
| Perfume | 0.4-0.6 |
| Water | Balance |

It should be appreciated that the present invention is not limited to the specific embodiments described above, but includes variations, modifications and equivalent embodiments defined by the following claims.

The invention claimed is:

1. A light duty liquid cleaning composition comprising at least one ammonium or metal salt of a $C_8$-$C_{16}$ linear alkyl benzene sulfonate surfactant, at least one ammonium or metal salt of an ethoxylated $C_8$-$C_{18}$ alkyl ether sulfate surfactant having 1 to 30 moles of ethylene oxide, at least one betaine surfactant, and a water-miscible organic solvent; wherein a. a total amount of surfactant in the composition is at least 30 weight %, b. the composition has a pH less than 7 and a viscosity of less than 75 cPs measured at 25° C., c. if a magnesium salt of a $C_8$-$C_{16}$ linear alkyl benzene sulfonate surfactant is present in the composition, it is present in an amount of 0.1 to less than 3 or greater than 16% by weight of the composition, d. the composition does not contain an inorganic magnesium salt, and e. the water-miscible organic solvent comprises dipropylene glycol methyl ether.

2. A light duty liquid cleaning composition comprising at least one ammonium or metal salt of a $C_8$-$C_{16}$ linear alkyl beuzene sulfonate surfactant, at least one ammonium or metal salt of an ethoxylated $C_8$-$C_{18}$ alkyl ether sulfate surfactant having 1 to 30 moles of ethylene oxide, at least one betaine surfactant, and a water-miscible organic solvent; wherein a. a total amount of surfactant in the composition is at least 30 weight %, b. the composition has a pH less than 7 and a viscosity of less than 75 cPs measured at 25° C.

c. if a magnesium salt of a $C_8$-$C_{16}$ linear alkyl benzene sulfonate surfactant is present in the composition, it is present in an amount of 0.1 to less than 3 or greater than 16% by weight of the composition.

d. the composition does not contain an inorganic magnesium salt, and e. the water-miscible organic solvent comprises dipropylene glycol methyl ether and ethanol.

3. A light duty liquid cleaning composition comprising at least one ammonium or metal salt of a $C_8$-$C_{16}$ linear alkyl benzene sulfonate surfactant, at least one ammonium or metal salt of an ethoxylated $C_8$-$C_{18}$ is alkyl ether sulfate surfactant having 1 to 30 moles of ethylene oxide, at least one betaine surfactant, and a corrosion inhibitor; wherein a. a total amount of surfactant in the composition is at least 30 weight %, b. the composition has a pH less than 7 and a viscosity of less than 75 cPs measured at 25° C., c. if a magnesium salt of a $C_8$-$C_{16}$ linear alkyl benzene sulfonate surfactant is present in the composition, it is present in an amount of 0.1 to less than 3 or greater than 16% by weight of the composition, and d. the composition does not contain an inorganic magnesium salt.

4. The light duty liquid cleaning composition of claim 3 wherein the corrosion inhibitor is present in an amount of 0.02 to 2.0 weight %.

5. The light duty liquid cleaning composition of claim 3 wherein the corrosion inhibitor is sodium sulfate.

6. A light duty liquid cleaning composition comprising at least one ammonium or metal salt of a $C_8$-$C_{16}$ linear alkyl benzene sulfonate surfactant, at least one ammonium or metal salt of an ethoxylated $C_8$-$C_{18}$ alkyl ether sulfate surfactant having 1 to 30 moles of ethylene oxide, at least one betaine surfactant, and pentasodium pentetate; wherein a. a total amount of surfactant in the composition is at least 30 weight %, b. the composition has a pH less than 7 and a viscosity of less than 75 cPs measured at 25° C., c. if a magnesium salt of a $C_8$-$C_{16}$ linear alkyl benzene sulfonate surfactant is present in the composition, it is present in an amount of 0.1 to less than 3 or greater than 16% by weight of the composition, and d. the composition does not contain an inorganic magnesium salt.

7. The light duty liquid cleaning composition of claim 1 wherein the composition has a pH less than 6.

8. The light duty liquid cleaning composition of claim 1 wherein the composition has a pH less than 5.

9. The light duty liquid cleaning composition of claim 2 wherein the composition has a pH less than 6.

10. The light duty liquid cleaning composition of claim 2 wherein the composition has a pH less than 5.

11. The light duty liquid cleaning composition of claim 3 wherein the composition has a pH less than 6.

12. The light duty liquid cleaning composition of claim 3 wherein the composition has a pH less than 5.

13. The light duty liquid cleaning composition of claim 6 wherein the composition has a pH less than 6.

14. The light duty liquid cleaning composition of claim 6 wherein the composition has a pH less than 5.

* * * * *